US008029416B2

(12) United States Patent
Eschenbach

(10) Patent No.: US 8,029,416 B2
(45) Date of Patent: Oct. 4, 2011

(54) FREE COURSE ELLIPTICAL EXERCISE APPARATUS

(76) Inventor: Paul William Eschenbach, Roebuck, SC (US)

( * ) Notice: Subject to any disclaimer, the term of this patent is extended or adjusted under 35 U.S.C. 154(b) by 32 days.

(21) Appl. No.: 12/657,039

(22) Filed: Jan. 13, 2010

(65) Prior Publication Data

US 2011/0172061 A1 Jul. 14, 2011

(51) Int. Cl.
*A63B 22/04* (2006.01)

(52) U.S. Cl. ..... 482/52

(58) Field of Classification Search ..... 482/51–53, 482/57, 62, 70–71; *A63B 22/04*
See application file for complete search history.

(56) References Cited

U.S. PATENT DOCUMENTS

| | | | | |
|---|---|---|---|---|
| 6,045,487 | A * | 4/2000 | Miller | 482/52 |
| 7,175,568 | B2 * | 2/2007 | Eschenbach | 482/52 |
| 7,507,184 | B2 | 3/2009 | Rodgers, Jr. | 482/52 |
| 7,520,839 | B2 | 4/2009 | Rodgers, Jr. | 482/52 |
| 7,641,598 | B2 | 1/2010 | Rodgers, Jr. | 482/52 |
| 7,678,025 | B2 * | 3/2010 | Rodgers, Jr. | 482/52 |
| 2009/0105049 | A1 | 4/2009 | Miller | 482/52 |
| 2009/0156369 | A1 | 6/2009 | Rodgers, Jr. | 482/52 |
| 2009/0156370 | A1 | 6/2009 | Rodgers, Jr. | 482/52 |
| 2009/0181828 | A1 | 7/2009 | Rodgers, Jr. | 482/52 |

* cited by examiner

*Primary Examiner* — Loan Thanh
*Assistant Examiner* — Oren Ginsberg

(57) ABSTRACT

The present invention relates to a standup exercise apparatus that simulates walking and jogging with arm exercise. More particularly, the present invention relates to an exercise machine having separately supported pedals for the feet and arm exercise coordinated with the motion of the feet where the pedal stride length is determined by the movements of an operator.

16 Claims, 2 Drawing Sheets

FREE COURSE ELLIPTICAL EXERCISE APPARATUS

BACKGROUND OF THE INVENTION

1. Field

The present invention relates to a standup exercise apparatus that simulates walking and jogging with arm exercise. More particularly, the present invention relates to an exercise machine having separately supported pedals for the feet and arm exercise coordinated with the motion of the feet where the pedal stride length is determined by the movements of an operator.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial fitness market called user defined motion elliptical cross trainers. These cross trainers guide the feet along a closed loop shaped curve to simulate the motions of jogging and climbing with varying stride lengths but tend to be complex and costly to fabricate. The shorter stride lengths have pedals which follow closed loop curves that are generally elliptical in shape. However, the longer stride lengths have pedals which follow somewhat different closed loop elongate curves. There is a need for a less complex user defined motion elliptical exercise apparatus capable of long, medium and shorter stride lengths where the pedals follow generally elongate curve paths.

User defined motion elliptical cross trainers are shown without cams in Rodgers, Jr. US Patent Applications 2009/0181828 and 2009/0156369 as well as U.S. Pat. Nos. 7,520,839 and 7,530,626 which show a pendulum striding exercise apparatus having a foot support members hung from a generally horizontal beam pivoted to achieve the varying stride length pedal curves. Rodgers, Jr. in U.S. Patent Application 2009/0156370 and U.S. Pat. Nos. 7,507,184 and 7,641,598 show exercise apparatus with flexible support elements having varying stride lengths. Miller in U.S. Patent Application 2009/0105049 also shows an exercise apparatus having varying stride lengths.

It is an objective of this invention to provide an exercise apparatus having varying stride lengths determined by the movement of an operator. A further objective is a less complex exercise apparatus having varying stride lengths where the pedals follow elongate curves for short, medium and long stride lengths.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong curve motion while pedal angles are controlled to vary about the horizontal during the pedal cycle. Arm exercise is by handles coordinated with the mechanism guiding the foot pedals. The range of handle movement determines the pedal stride length.

In the preferred embodiment, the apparatus includes a separate pedal for each foot attached to a foot support member. A pair of crank arms rotate about a pivot axis positioned on the framework. A pair of first support links are pivotally connected to the crank arms and to foot support members. A pair of second support links are pivotally connected to the framework and to the foot support members. A pair of handles are pivotally connected to the framework. A pair of connector links are pivotally connected to the handles and to one end of the first support links. A cross member is pivotally connected to the framework. A pair of crossing links are pivotally connected to the cross member and to each handle. The crossover member and crossing links form a crossover assembly to cause one handle to move forward while the other handle moves rearward.

The stride length of the pedal is determined by the range of movement of the handle. The shortest stride length occurs with no movement of the handles while the longest stride length of the pedals occurs with the longest range of movement of the handles.

Load resistance is applied to the crank in this embodiment by a pulley which drives a belt to a smaller pulley attached to a flywheel supported by the framework. A tension belt covers the circumference of the flywheel to provide friction for load resistance on the intensity of exercise. The tension on the tension belt can be adjusted to vary the intensity of exercise. It should be understood that other forms of load resistance such as magnetic, alternator, air fan or others may be applied to the crank.

In summary, this invention provides the operator with varying elliptical stride lengths having stable foot pedal support that simulate walking and jogging with very low joint impact with variable range arm exercise. The range of handle movement determines the length of pedal stride.

DETAILED DESCRIPTION OF THE EMBODIMENTS

Figure 1:
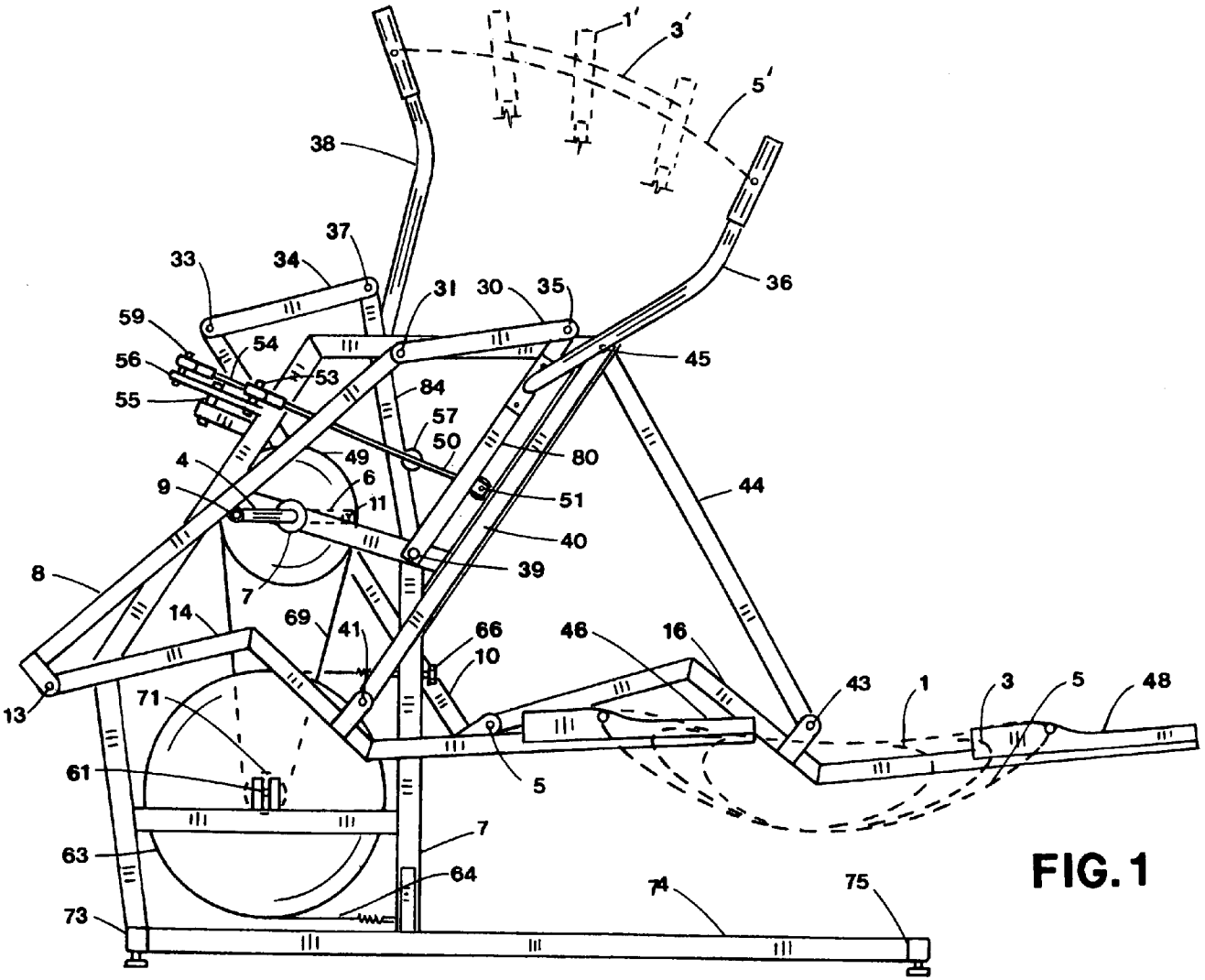
FIG. 1 is a right side elevation view of the preferred embodiment of an exercise machine constructed in accordance with the present invention.
Figure 2:
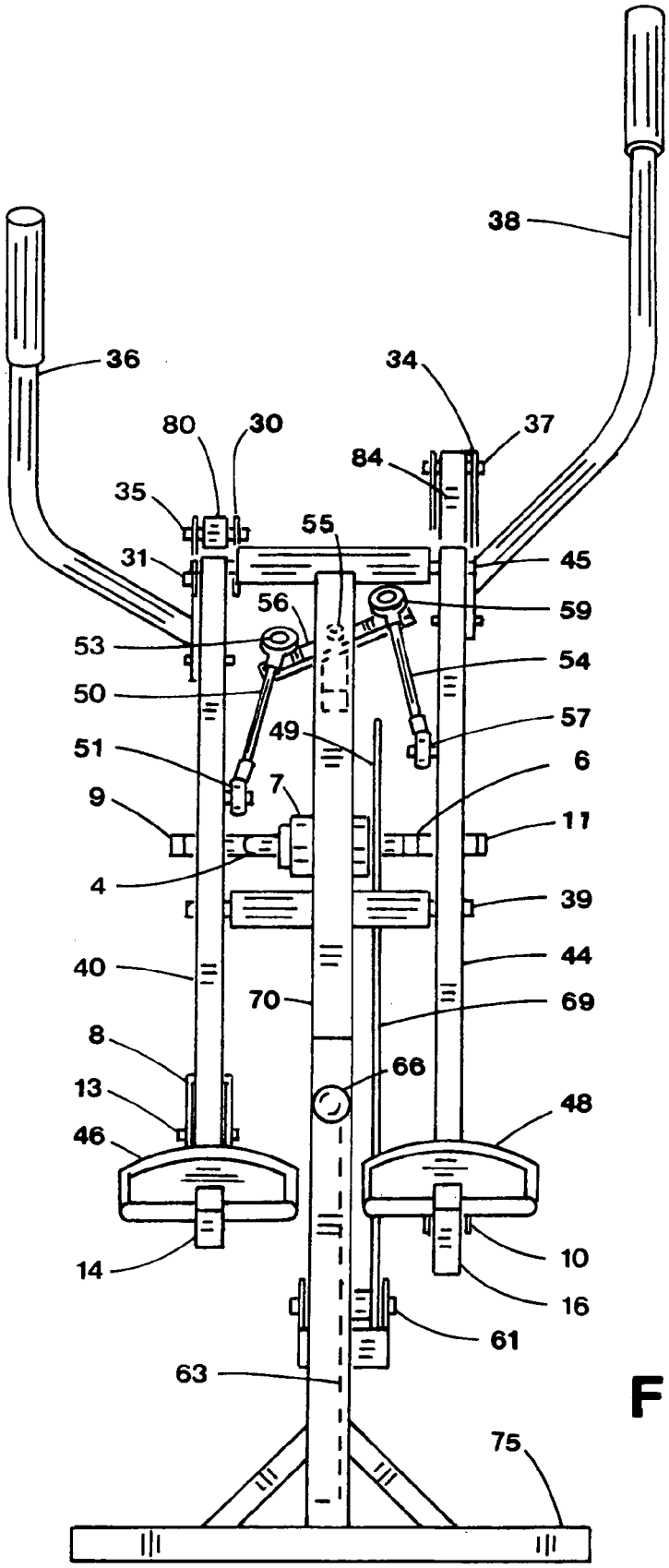
FIG. 2 is the rear view of the preferred embodiment shown in FIG. 1.

Referring to the drawings in detail, pedals 46 and 48 are shown in FIGS. 1 and 2 in forward and rearward positions of the preferred embodiment. Crank arms 4,6 rotate about pivot axis 7 positioned upon framework 70. Foot support members 14,16 have pedals 46,48 attached. First support links 8,10 are connected to crank arms 4,6 at pivots 9,11 which are positioned intermediate the length of first support links 8,10 and connected to foot support members 14,16 at pivots 13,15. Second support links 40,44 are connected to framework 70 at pivot 45 and to foot support members 14,16 at pivots 41,43.

Handles 36,38 are attached to handle extensions 80,84 which are connected to framework 70 at pivot 39. Connector links 30,34 are connected to handle extensions 80,84 at pivots 35,37 and to one end of first support links 8,10 at pivots 31,33. Crossover member 56 is connected to framework 70 at pivot 55. Crossing links 50,54 are connected to crossover member 56 at pivots 53,59 and to handle extensions 84,80 at pivots 51,57. Crossover member 56 and crossing links 50,54 form a crossover assembly as shown in FIGS. 1 and 2 that cause handle 36 to move forward when handle 38 moves rearward.

Load resistance is imposed upon cranks 4,6 by pulley 49 which drives flywheel 63 by belt 69 coupled to pulley 71 which is supported by the framework 70 at shaft 61. Tension belt 64 encompasses flywheel 63 with adjustment device 66 connected to vary the intensity of exercise on the exercise apparatus. Framework 70 is attached to longitudinal frame members 74 which are attached to cross members 73,75 that are supported by a generally horizontal surface.

Operation begins when an operator places the feet upon the pedals 46,48 in the default side by side position of pedals 46,48. Holding handles 36,38 generally still as denoted by 1', pedals 46,48 move through a relatively short pedal curve 1 shown in FIG. 1. Allowing the handles 36,38 to move through handle range 3' causes pedals 46,48 to move along pedal curve 3. Allowing handles 36,38 to move through handle range 5' results in pedal curve 5. Note that pedal curves 1 and 3 are generally elliptical in shape.

In summary, the present invention has distinct advantages over prior art because the back and forth elliptical stride movement of the pedals 46,48 can be changed by the range of movement 1',3',5' of the handles 36,38 while maintaining a generally elongate pedal curves 1,3,5 and is less complex than prior art.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus configured for operator motion determined stride length comprising;

a framework, said framework configured to be supported on a generally horizontal surface;

a pair of crank arms, said crank arms being connected to rotate about a pivot axis on said framework;

a pair of foot support members, each said foot support member having a foot engaging pedal attached;

a pair of first support links, each said first support link directly connected intermediate the length of said first support link to a respective said crank arm sharing a common pivot and pivotally connected to a respective said foot support member at one end of said first support link;

a pair of second support links, each said second support link directly connected to a respective said foot support member sharing a common pivot and pivotally connected to said framework;

a pair of handles for arm exercise, each said handle pivotally connected to said framework;

a pair of connector links, each said connector link pivotally connected to a respective said handle and at the other terminal end of a respective said first support link;

said crank arms, said first support links, said second support links, said connector links and said foot support members being configured to constrain said pedals to follow a shortest elongate path while said operator holds said handles stationary during operation;

a crossover assembly, said crossover assembly operably associated with said handles to cause one said handle to move in a direction opposed to the other said handle;

said pedals configured to move relative to said framework when the foot of said operator is rotating said crank arms whereby said pedals follow an elongate curve path wherein said stride length of the shortest to the longest of said elongate curve path is determined by the position of said handles relative to said framework during movement of said operator.

2. The exercise apparatus according to claim 1 wherein said elongate curve path is generally elliptical in shape and the stride length of the shortest elongate curve path obtainable is significantly less than the stride length for the longest elongate curve path.

3. The exercise apparatus according to claim 1 wherein said crossover assembly comprises:

a crossover member, said crossover member pivotally connected to said framework intermediate the ends of said crossover member;

a pair of crossing links, each said crossing link pivotally connected to one end of said crossover member and to a respective said handle whereby forward movement of one said handle causes the rearward movement of the other said handle.

4. The exercise apparatus according to claim 1 further comprising a flywheel, said flywheel operably associated with said crank arms.

5. The exercise apparatus according to claim 1 further comprising a load resistance device, said load resistance device operably associated with said crank arms.

6. The exercise apparatus according to claim 5 wherein said load resistance device is adjustable to vary the intensity of exercise.

7. An exercise apparatus configured for operator motion determined stride length comprising;

a framework, said framework configured to be supported on a generally horizontal surface;

a pair of crank arms, said crank arms being connected to rotate about a pivot axis on said framework;

a pair of foot support members, each said foot support member having a foot engaging pedal attached;

a pair of first support links, each said first support link directly connected intermediate the length of said first support link to a respective said crank arm sharing a common pivot and pivotally connected to a respective said foot support member at one end of said first support link;

a pair of second support links, each said second support link directly connected to a respective said foot support member sharing a common pivot and pivotally connected to said framework;

a pair of handles for arm exercise, each said handle pivotally connected to said framework;

a pair of connector links, each said connector link pivotally connected to a respective said handle and to a respective said first support link positioned at the other terminal end of said first support link;

said crank arms, said first support links, said second support links, said connector links and said foot support members being configured to constrain said pedals to follow a shortest elongate path while said operator holds said handles stationary during operation;

a crossover member, said crossover member pivotally connected to said framework intermediate the ends of said crossover member;

a pair of crossing links, each said crossing link pivotally connected to one end of said crossover member and to a respective said handle such that forward movement of one said handle causes the rearward movement of the other said handle;

said pedals configured to move relative to said framework when the foot of said operator is rotating said crank arms whereby said pedals follow a closed elongate curve path wherein the shortest to longest said stride length of said closed elongate curve path is determined by the handle movement of said operator with the shortest said stride length of said closed elongate curve path occurring when the handles are held stationary allowing easy start-up of said exercise apparatus.

8. The exercise apparatus according to claim 7 further comprising a flywheel, said flywheel operably associated with said crank arms.

9. The exercise apparatus according to claim 7 further comprising a load resistance device, said load resistance device operably associated with said crank arms.

10. The exercise apparatus according to claim 9 wherein said load resistance device is adjustable to vary the intensity of exercise.

11. An exercise apparatus configured for operator motion determined stride length comprising;

a framework, said framework configured to be supported on a generally horizontal surface;

a pair of crank arms, said crank arms being connected to rotate about a pivot axis on said framework;

a pair of foot support members, each said foot support member having a first portion, a second portion and a foot engaging pedal;

a pair of first support links, each said first support link directly connected intermediate the length of said first support link to a respective said crank arm sharing a common pivot and pivotally connected to a respective said foot support member at one end of said first support link to cause said first portion of said foot support member to have a generally up and down movement;

a pair of second support links, each said second support link directly connected to a respective said foot support member sharing a common pivot and pivotally connected to said framework to cause said second portion of said foot support member to have a generally back and forth movement;

a pair of handles for arm exercise, each said handle pivotally connected to said framework intermediate said pivot axis and said second support links;

a pair of connector links, each said connector link pivotally connected to a respective said handle and to the other terminal end of a respective said first foot support link;

said crank arms, said first support links, said second support links, said connector links and said foot support members being configured to constrain said pedals to follow a shortest elongate path while said operator holds said handles stationary during operation;

a crossover assembly, said crossover assembly operably associated with said handles to cause one said handle to move in a direction opposed to the other said handle;

said pedals configured to move relative to said framework when the foot of said operator is rotating said crank arms whereby said pedals follow an elongate curve path wherein said stride length of said elongate curve path is determined by the range of movement of said handles.

12. The exercise apparatus according to claim 11 wherein said foot support member is configured with said pedal on one end and said first portion at the other end with said second portion intermediate the ends.

13. The exercise apparatus according to claim 11 wherein said crossover assembly comprises:

a crossover member, said crossover member pivotally connected to said framework intermediate the ends of said crossover member;

a pair of crossing links, each said crossing link pivotally connected to one end of said crossover member and to a respective said handle whereby forward movement of one said handle causes the rearward movement of the other said handle.

14. The exercise apparatus according to claim 11 further comprising a flywheel, said flywheel operably associated with said crank arms.

15. The exercise apparatus according to claim 11 further comprising a load resistance device, said load resistance device operably associated with said crank arms.

16. The exercise apparatus according to claim 15 wherein said load resistance device is adjustable to vary the intensity of exercise.

* * * * *